US005115780A

United States Patent [19]

Jönsson et al.

[11] Patent Number: 5,115,780

[45] Date of Patent: May 26, 1992

[54] ARRANGEMENT FOR RESTRICTING THE TEMPERATURE OF COMBUSTION ENGINE EXHAUST GASES

[75] Inventors: Nils Jönsson, Stocksund; Mats Dahlgren, Lidingö, both of Sweden

[73] Assignee: Nira Automotive AB, Enebyberg, Sweden

[21] Appl. No.: 613,570

[22] PCT Filed: Jun. 13, 1989

[86] PCT No.: PCT/SE89/00338

§ 371 Date: Nov. 29, 1990

§ 102(e) Date: Nov. 29, 1990

[87] PCT Pub. No.: WO89/12739

PCT Pub. Date: Dec. 28, 1989

[30] Foreign Application Priority Data

Jun. 14, 1988 [SE] Sweden ..... 8802226

[51] Int. Cl.[5] ..... F02D 41/04; F02M 25/02

[52] U.S. Cl. ..... 123/478; 123/25 A

[58] Field of Search ..... 123/1 A, 25 A, 25 B, 123/25 C, 25 D, 25 E, 25 F, 25 K, 25 Q, 478, 480, 489

[56] References Cited

U.S. PATENT DOCUMENTS

| | | | |
|---|---|---|---|
| 4,231,333 | 11/1980 | Thatcher et al. | 123/478 X |
| 4,389,994 | 6/1983 | Denz et al. | 123/478 |
| 4,408,585 | 10/1983 | Stuckas | 123/440 |
| 4,558,665 | 12/1985 | Sandberg et al. | 123/25 C |
| 4,561,403 | 12/1985 | Oyama et al. | 123/489 |
| 4,671,234 | 6/1987 | Tegtmeier | 123/432 |
| 4,683,854 | 8/1987 | Goulet | 123/478 |
| 4,825,836 | 5/1989 | Hirose | 123/478 |
| 4,976,226 | 12/1990 | Herman | 123/25 C |

FOREIGN PATENT DOCUMENTS

| | | |
|---|---|---|
| 0136519 | 11/1989 | European Pat. Off. . |
| 61-55340 | 3/1986 | Japan . |
| 0441207 | 9/1985 | Sweden . |

*Primary Examiner*—Willis R. Wolfe
*Attorney, Agent, or Firm*—Young & Thompson

[57] ABSTRACT

Device for limiting the exhaust gas temperature in an internal combustion engine consisting of a thermoelement (2) protruding into the engine exhaust manifold (1) and an electronic control unit (3) connected thereto, which is disposed to send an output signal dependent on the exhaust gas temperature sensed by the thermoelement to the fuel injection system (4) of the engine. When the output signal indicates that the temperature exceeds a maximum-permissible level, an excess of fuel is injected for cooling.

8 Claims, 3 Drawing Sheets

| TEMP. | DC |
|---|---|
| 940 | 2 |
| 945 | 11 |
| 950 | 21 |
| 955 | 31 |
| 960 | 40 |
| 965 | 51 |
| 970 | 62 |
| 975 | 78 |
| 980 | 100 |

ARRANGEMENT FOR RESTRICTING THE TEMPERATURE OF COMBUSTION ENGINE EXHAUST GASES

FIELD OF THE INVENTION

The present invention relates to a device for limiting the exhaust temperature in an internal combustion engine, comprising means for supplying a cooling medium to the combustion chamber of the engine.

BACKGROUND OF THE INVENTION

When designing modern internal combustion engines, especially supercharged engines, the exhaust temperature is an important parameter to be taken into consideration, due to firstly the relatively large gas flow in supercharged engines relative to the cylinder volume, secondly the higher exhaust counter-pressure when using catalytic exhaust converters leading to elevated exhaust temperatures, and thirdly the tendency to knock resulting from the desired to keep a relatively high compression ratio for preserving good engine suction characteristics.

A known method of limiting the maximum level of the exhaust gas temperature is to inject a cooling medium into the combustion chamber of the engine at those engine load conditions where there is risk that the temperature may exceed the maximum permissible level. Water can be used as a cooling medium injected into the combustion chamber through special injectors. The most common method is however to use extra fuel as a cooling medium and to quite simply use the ordinary engine injection system for making the engine fuel-air mixture richer.

Known systems for limiting exhaust gas temperature by injecting a cooling agent lack feedback circuits, and this means that one must assume a worst case situation when calculating the amount to be injected. The system must be designed with the assumption that the engine is operated with low octane fuel at high ambient temperature with maximum load and that these conditions shall prevail for a long period of time. This results in poor fuel economy since when driving normally even with a high load there is seldom any need to add extra fuel and temporary increases in load, such as when passing, do not bring the exhaust temperature to a critical value. Another disadvantage is that the exhaust gas temperature will be unnecessarily low when driving on high octane fuel at normal ambient temperature, and this results in a non-optimal fuel-air mixture ratio.

SUMMARY OF THE INVENTION

The purpose of the present invention is to provide a device of the type described by way of introduction which makes it possible to optimize the supply of cooling medium in such a manner that the medium is only supplied when there is actual need for cooling.

This is achieved according to the invention by means of a temperature-sensing means protruding into an exhaust-conducting conduit and which is coupled to a control unit for sending an exhaust gas temperature-dependent signal to the control unit, which in turn is coupled to said cooling medium-conducting means for controlling the supply of cooling medium as a function of the exhaust gas temperature.

The invention provides feedback or reaction control which makes it possible to optimize the engine for high octane fuel and normal driving conditions. When using supercharged engines, the gain will be lower fuel consumption under precisely those operating conditions where supercharged engines normally have very high fuel consumption.

The device according to the invention can be used to control injection of cooling medium in the form of fuel or water through a separate valve in the engine induction pipe, e.g. the start valve in an engine with fuel injection, but in a preferred embodiment for engines with fuel injection, the control unit is coupled to the fuel injection system to direct it to inject an excess of fuel through the ordinary injectors at exhaust gas temperatures above a certain level.

BRIEF DESCRIPTION OF THE DRAWINGS

The invention is described below with reference to the accompanying drawings, where.

DESCRIPTION OF THE PREFERRED EMBODIMENTS

Figure 1:
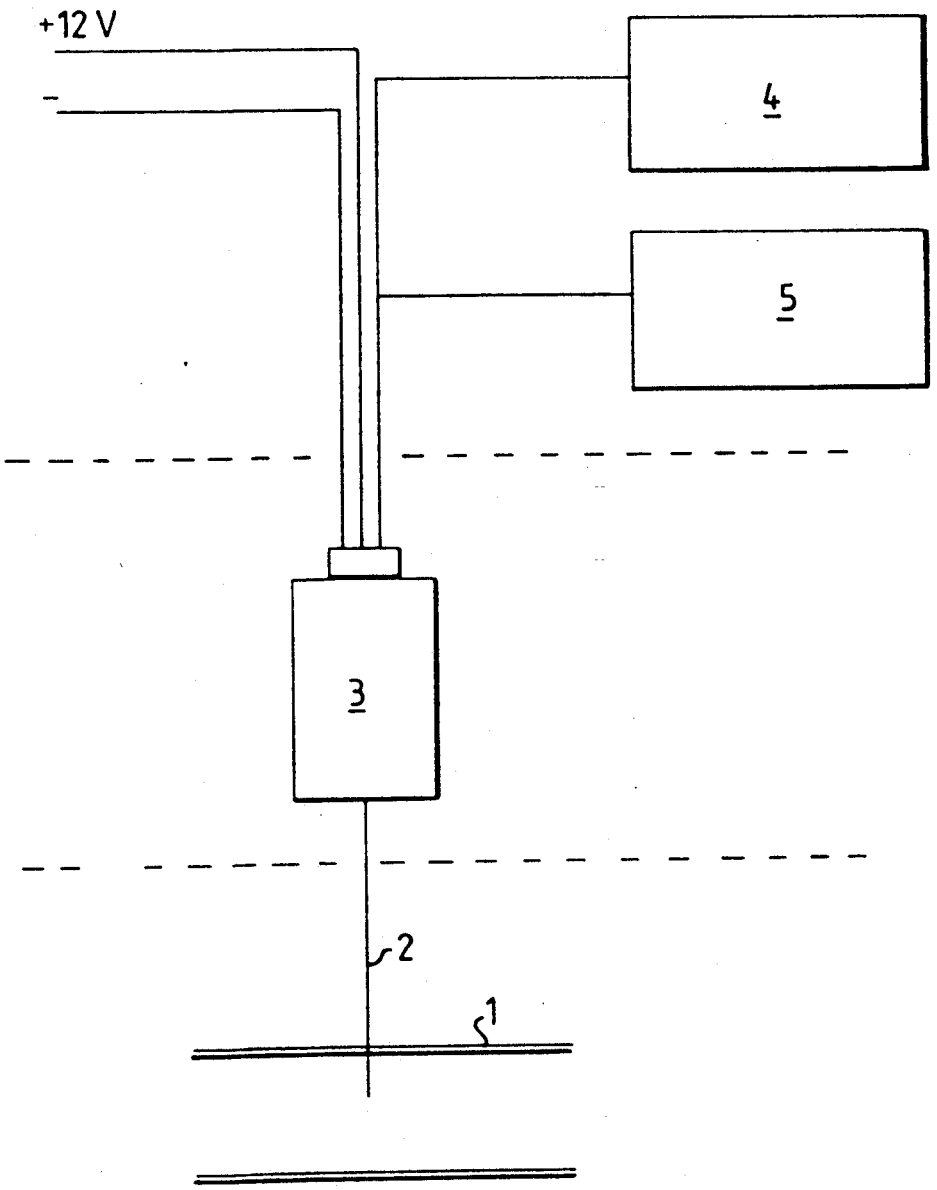
FIG. 1 shows a block diagram of a preferred embodiment.

In FIG. 1, 1 designates the exhaust manifold of an internal combustion engine. Into the manifold and preferably as close to the exhaust valve as possible, there protrudes one end of a thermoelement 2, which can be of the encapsulated type with a diameter of 3 mm and a length of about 200 mm. The thermoelement 2 is coupled to a control unit 3, in the form of an electronic unit built up by so-called hybride technology, i.e. the components are applied to a ceramic substrate to make the control unit able to withstand high temperatures. The thermoelement 2 is suitably embedded in the electronic unit 3 and this unit should be mounted as close to the manifold as temperature considerations permit and on a component which vibrates in the same manner as the manifold at the point of measurement.

The control unit 3 electronics contain circuits for converting the weak electrical signal from the thermoelement to a pulse width-modulated output signal which in the embodiment shown in FIG. 1 is fed to the control electronics in an electronic fuel-injection system 4 which is known per se with an injector for each cylinder. The output signal has a duty cycle in which the "on-time" increases with increasing exhaust gas temperatures above a certain level. The injection system 4 measures the duty cycle of the signal from the control unit 3 and uses it as an extra parameter when calculating the open time for the fuel injection valves.

Figure 2:
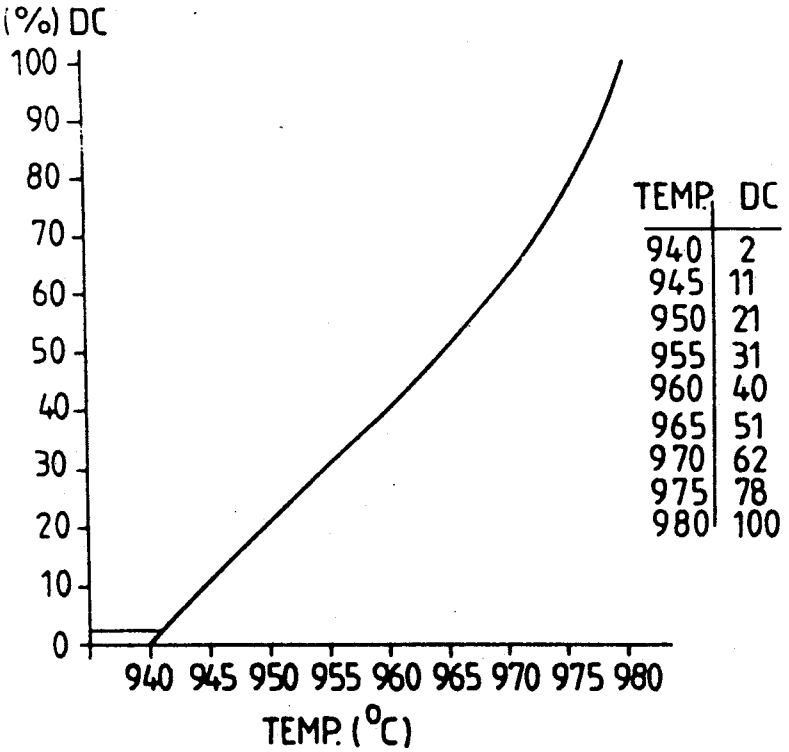
FIG. 2 shows a diagram illustrating the duty cycle of the control unit as a function of exhaust gas temperature.

FIG. 2 illustrates the duty cycle as a non-linear function of the exhaust gas temperature between 940° C. and 980° C. A minimum duty cycle of 2% is generated by a special circuit in the control unit 3. This pulse is a so-called "diagnostic pulse", which is superimposed on the temperature-dependent pulse and enables faults to be detected in the system, e.g. when the device according to the invention is used in a turbocharged engine together with a turbocontrol system 5 (FIG. 1) of the type described in PCT/SE 88/00283. The diagnostic pulse indicates only that the unit 2,3 is functioning correctly at exhaust gas temperatures below 940° C. It is too short to affect the fuel injection.

Figure 3:
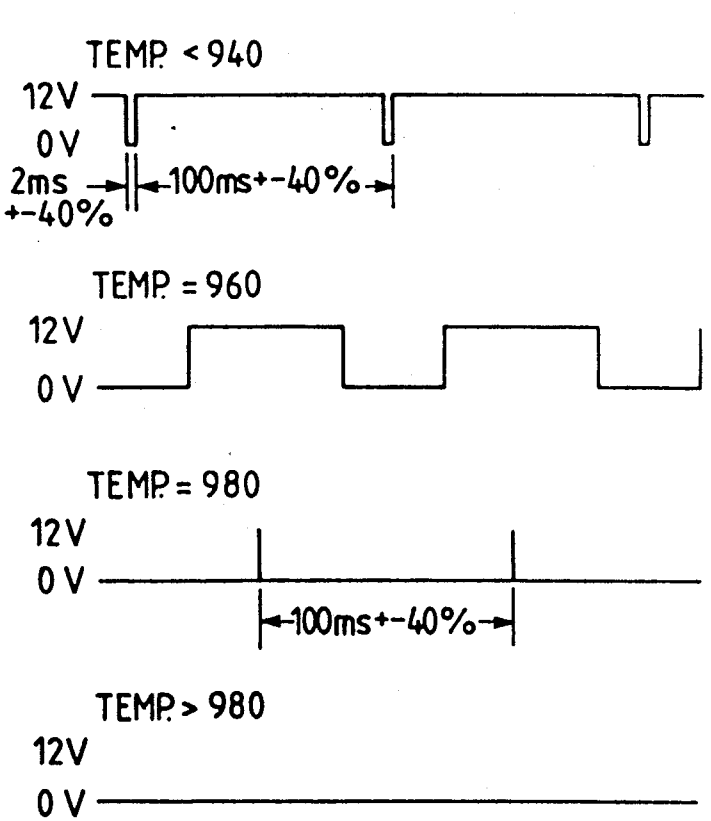
FIG. 3 shows a diagram illustrating the shape of the pulse at several selected exhaust gas temperatures.

A duty cycle of for example 100% or 0% can be selected as indication that a fault has arisen in the system. In the diagram in FIG. 3 the signal frequency is 10 Hz and the 0% criteria can be that the measured pulse length is equal to or less than 1 ms. The criteria of 100% DC can be that the measured pulse length is greater than 99 ms. In both cases this can suitable result in a warning light being lit on the instrument panel.

Figure 4:
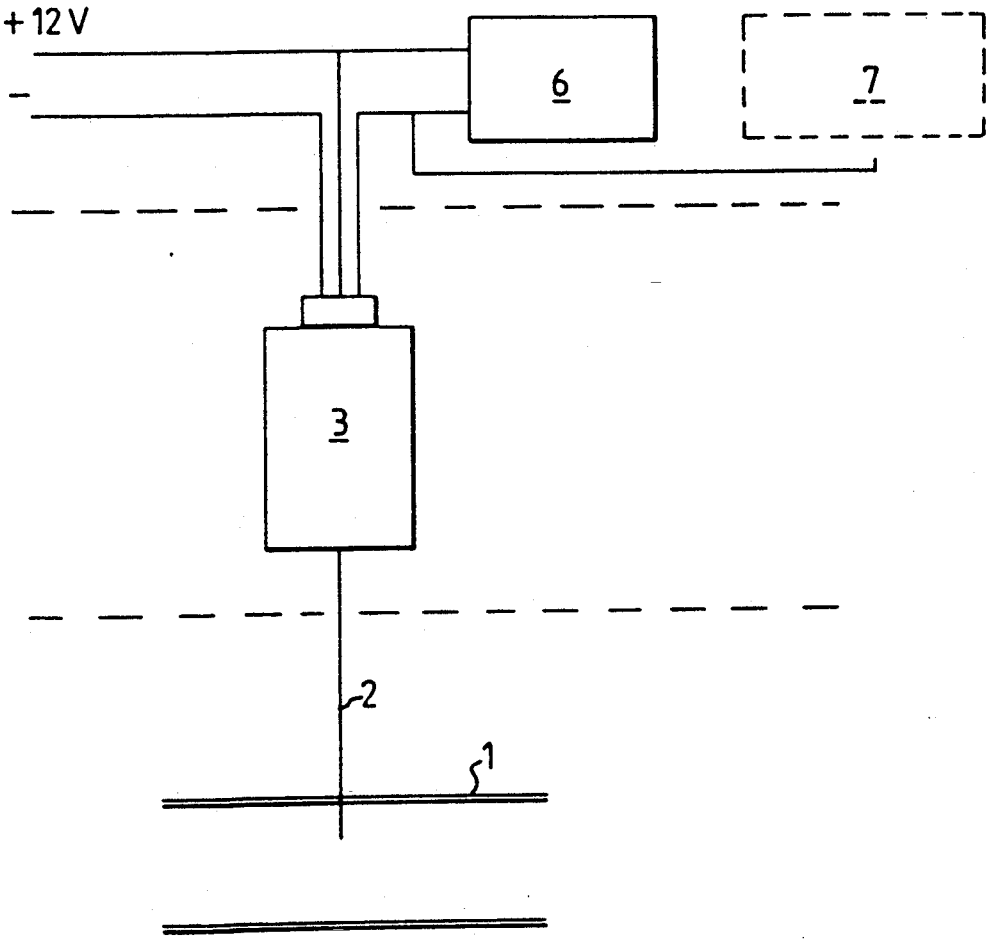
FIG. 4 shows a block diagram of a second embodiment.

Instead of as in the example described above, allowing the unit 3 to affect the supply of fuel through the ordinary injection valves of an injection system via the control electronics of the injection system, it is possible within the scope or the invention to connect the unit 3 directly to a single injection valve 6 (see FIG. 4) disposed in the engine induction pipe. This valve can be specially designed for injection of cooling medium. Alternatively, the start valve in a fuel injection system can be used for this purpose. The valve 6 can be controlled to inject fuel intermittently in time with the control unit 3 pulses and is completely open at 100% DC. In FIG. 4, 7 designates extra equipment for diagnosis of faults in the signal from the unit 3.

We claim:

1. Device for limiting exhaust gas temperature in an internal combustion engine having an exhaust manifold, comprising means for supplying a cooling medium to the combustion chamber of the engine, temperature-sensing means (2) protruding into an exhaust gas conducting conduit (1) for sensing the temperature in the exhaust manifold, said temperature-sensing means being coupled to a control unit (3) for sending an exhaust gas temperature-dependent signal to the control unit, said control unit being coupled to said cooling medium supplying means (4; 7) so as to supply a certain amount of cooling medium at a first exhaust gas temperature level and to successively increase the amount of cooling medium at increasing exhaust gas temperatures above the first level to a certain maximum amount of cooling medium at a second exhaust gas temperature level, said supply of cooling medium being dependent only on the exhaust gas temperature in the exhaust manifold.

2. Device according to claim 1, wherein the temperature-sensing means (2) is a thermoelement protruding into the engine exhaust manifold.

3. Device according to claim 1, for an engine with a fuel injection system having injection valves, wherein the control unit (3) is disposed to actuate the injection system (4; 7) to supply an excess of fuel to the combustion chamber of the engine at exhaust gas temperatures above a certain first level.

4. Device according to claim 3, wherein the control unit l(3) is disposed to actuate the fuel injection system (4) to inject an excess of fuel, through said fuel injection valves of the injection system.

5. Device according to claim 3, wherein the engine has an engine induction pipe, and the control unit (3) is disposed to control the injection of fuel through a separate valve device (7) disposed in said engine induction pipe.

6. Device according to claim 1, wherein the control unit (3) is disposed to send a pulse width-modulated output signal where duty cycle is a function of the temperature sensed by the temperature-sensing means (2).

7. Device according to claim 6, wherein the output signal is a non-linear function of the exhaust gas temperature.

8. Device according to claim 6, wherein the control unit (3) is disposed to send an output signal with a duty cycle (DC) which is less than the minimum duty cycle of the exhaust gas temperature-dependent output signal, said first mentioned signal being superimposed on the temperature-dependent out-put signal and being a signal for continuous checking of the functioning of the control unit at exhaust gas temperatures below said first level.

* * * * *